United States Patent [19]

Doty

[11] Patent Number: 4,498,260

[45] Date of Patent: Feb. 12, 1985

[54] TOOL FOR OPTICALLY FINISHING MULTIPLE MOUNTED OPTICAL FIBERS

[75] Inventor: John S Doty, Yucaipa, Calif.

[73] Assignee: Hughes Aircraft Company, El Segundo, Calif.

[21] Appl. No.: 376,866

[22] Filed: May 10, 1982

[51] Int. Cl.[3] ..... B24B 41/06

[52] U.S. Cl. ..... 51/217 R; 51/227 H

[58] Field of Search ..... 51/217 R, 216 R, 216 H, 51/168, 227 H, 217 L

[56] References Cited

U.S. PATENT DOCUMENTS

| | | | |
|---|---|---|---|
| 1,522,123 | 1/1925 | Higgins | 51/217 R |
| 2,525,264 | 10/1950 | Milner et al. | 51/227 H |
| 2,672,714 | 3/1954 | Wilson | 51/216 H |
| 2,834,620 | 5/1958 | Maude | 51/168 |
| 4,330,965 | 5/1982 | Clark | 51/217 R |

*Primary Examiner*—James G. Smith
*Assistant Examiner*—Judy J. Hartman
*Attorney, Agent, or Firm*—Lewis B. Sternfels; William J. Bethurum; A. W. Karambelas

[57] ABSTRACT

The axial positions of two or more fibers are simultaneously controlled in three grinding or polishing stages. The fibers (72) are first ground flush with the guide (120) in which they are housed. The fiber ends and faces of the guides are then ground flat and square. The fibers are thereafter polished to their optical quality and required length. The tool for accomplishing these steps includes a retainer (74) which holds the assembly (73) of fiber optic ferrules (70) and their optical fibers (72) therein at a tool surface (16). This tool surface is protected by a guard (18) from being too rapidly ground away while the fibers and fiber/guide combinations are ground flush with the surface. The surface and its retained guides and fibers are then axially moved to an unprotected position (FIG. 3) so that the surfaces and the fibers within their ferrules may be polished on a suitable polishing wheel or similar device.

5 Claims, 4 Drawing Figures

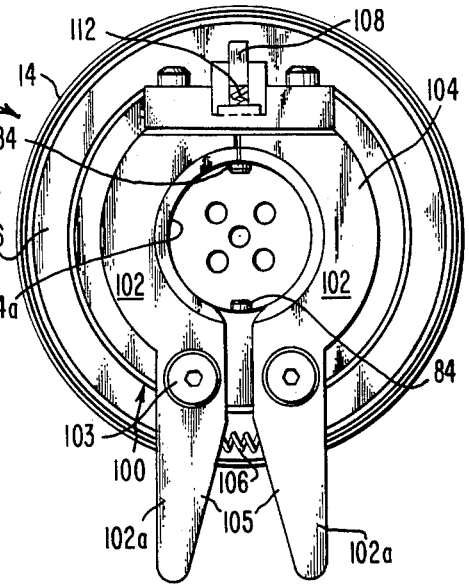
Fig. 3.
Fig. 2.
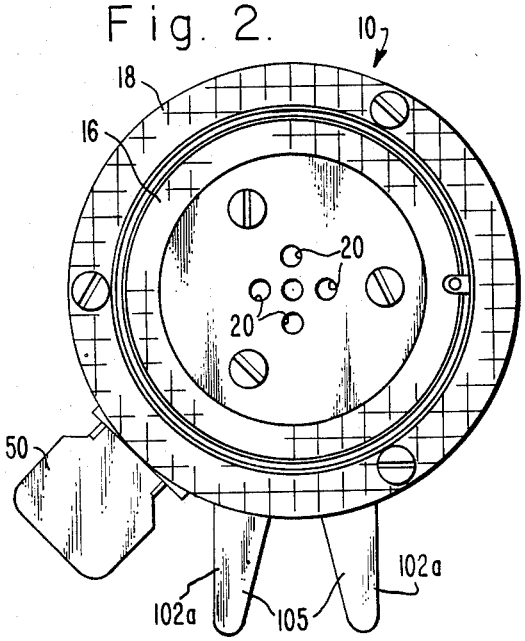
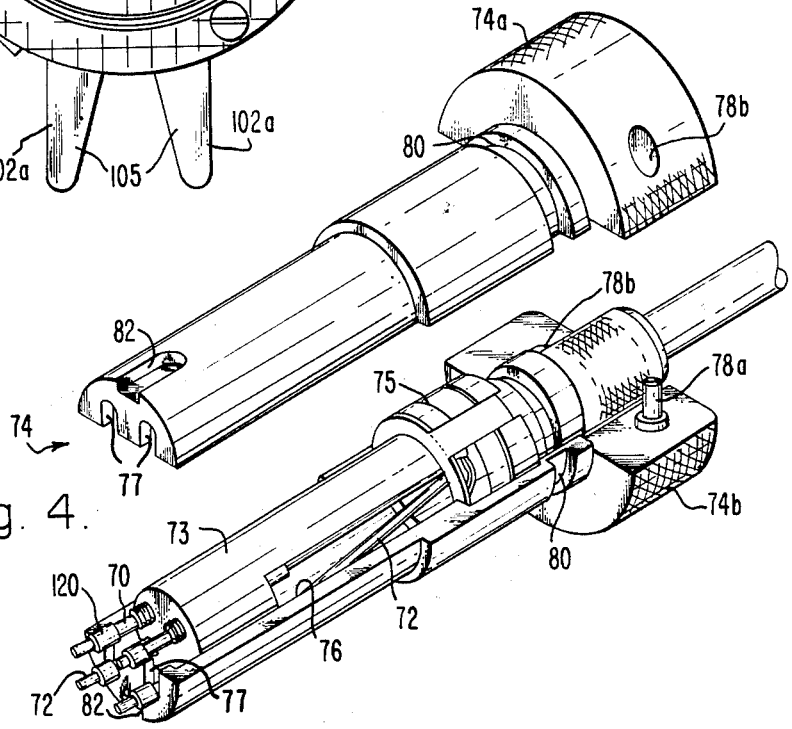
Fig. 4.

TOOL FOR OPTICALLY FINISHING MULTIPLE MOUNTED OPTICAL FIBERS

TECHNICAL FIELD

The present invention relates to a tool which is useful in simultaneously producing optically finished transmitting/receiving end faces on a plurality of optical waveguides.

CROSS-REFERENCE TO RELATED APPLICATIONS

The present invention has particular use for simultaneously optically finishing the end faces of a plurality of optical waveguides mounted in the fiber optic connector of copending patent application, Ser. No. 65,032, and constitutes an improvement over U.S. Pat. No. 4,330,965 issued May 25, 1982.

BACKGROUND OF THE INVENTION

It is essential that, when optical fibers are to be optically coupled in a connect-disconnect mechanism, the mating ends of the fibers be optically finished to preclude or, at least, to minimize losses in transmission through reflection or scattering of the transmitted signals at their end faces. There are many well known methods for providing an adequately finished fiber optic end, including proper cleavage of glass fiber, and polishing of the fiber ends when encapsulated or otherwise held within an optical fiber ferrule. While successful to a greater or lesser extent, improvements are still needed, especially where it is necessary to mass produce optically polished fiber ends by use of relatively unskilled labor. When, more than one optical fiber is to be mounted in a connector, further problems arise if the fibers are not to be twisted or broken as would occur in the threaded construction of above-identified U.S. Pat. No. 4,330,965 issued May 25, 1982.

SUMMARY OF THE INVENTION

The present invention accomplishes these and other objectives and overcomes the breakage problems by simultaneously controlling the axial position of two or more fibers in three grinding or polishing stages while the fibers, as retained in individual contacts or ferrules, are mounted together in an assembly mount, to position and hold their end faces even in a common plane. The glass fibers in their contacts, as a unit, are first ground flush with their contacts. The fiber ends and face of the contacts are then ground flat and square. The fibers are thereafter polished to their optical quality and required lengths.

The tool for accomplishing these steps, in its preferred embodiment, includes a retainer which holds the assembly mount and, therefore, the fiber optic contacts or ferrules and their optical fibers therein at a tool surface. This tool surface is protected by a guard from being too rapidly ground away while the fibers and fiber contacts are ground flush with the surface. The surface and its retained contacts and fibers are then axially moved, but not rotated, to an unprotected position so that the surface and the fibers within their contacts may be positioned on a suitable polishing wheel or similar device.

One advantage of the present invention provides a means by which optical finishes can be applied simultaneously to the end faces of optical fibers mounted in their optical fiber ferrules or contacts, without subjecting the fibers to twisting or torsion.

Other aims and advantages as well as a complete understanding of the present invention will appear from the following explanation of an exemplary embodiment and the accompanying drawings thereof.

BRIEF DESCRIPTION OF THE DRAWINGS

FIG. 2 is a view of the bottom of the tool, showing its grinding and polishing surfaces;

FIG. 3 is a view of the top of the tool with the split cradle removed; and

FIG. 4 depicts the split cradle and the assembly mount in which the fiber optic ferrules are retained.

DETAILED DESCRIPTION OF THE INVENTION

Figure 1:
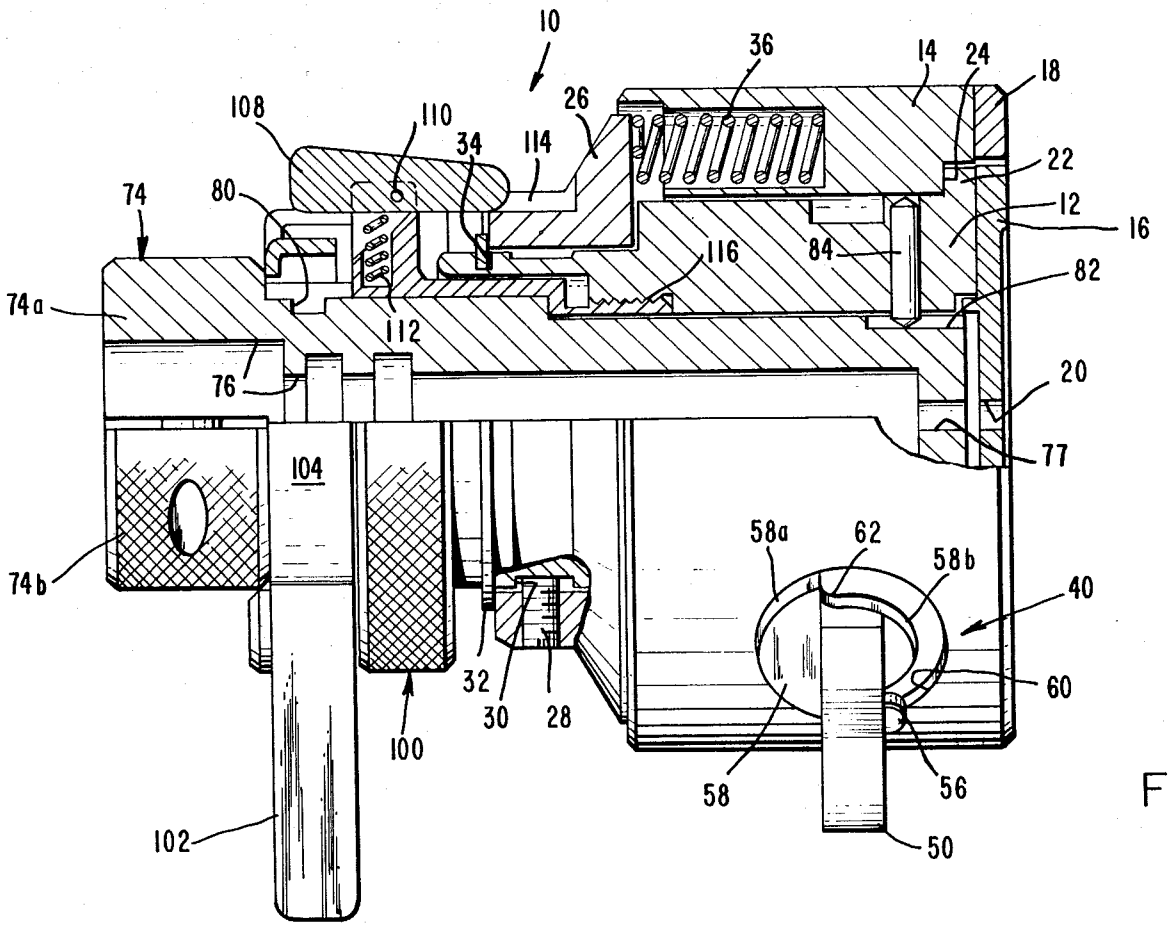
FIG. 1 is a view of the preferred embodiment of the tool for grinding and polishing the end faces of two or more optical fibers while held in their ferrules and the ferrules are retained in an assembly mount (shown in FIG. 4), the tool being shown in partial cross-section prior to insertion of the assembly mount into a split cradle.

As illustrated in the drawings, a hand-held fiber optic ferrule grinding and polishing tool 10 includes a body 12 of generally cylindrical configuration which is concentrically placed within a spring housing 14. For convenience, these as well as most other parts are all made of aluminum, except as otherwise indicated. For example, it is preferred that body 12 be provided with an end surface which is of a relatively softer material than the end surface of housing 14. Accordingly, the end surface of body 12 comprises a plate 16 of brass while the end surface of spring housing 14 comprises an annular limiting ring plate 18 of stainless steel. Two or more centrally located holes 20 in plate 16 support the ends of as many fiber optic contracts as are to be ground and polished. For purposes of example, four holes 20 for four optical fibers and ferrules are depicted.

At its forward end, body 12 has a radially extending flange 22 which is adapted to cooperate with a recess 24 in spring housing 14 to limit forward movement of the spring housing with respect to the body and, thereby, to ensure that the polishing and grinding surfaces of plates 16 and 18 are flush, one with respect to the other. It is to be understood that the surfaces of plates 16 and 18 do not have grinding and polishing abrasive materials in them, but are disposed to be placed against such materials on grinding and polishing wheels at appropriate times during grinding and polishing of the fiber optic contact ends. For convenience of describing their use, however, they are termed "grinding" and "polishing" surfaces.

At the opposite end of body 12, an adjustable annulus 26 is secured to the body by a set screw 28 which is normally engaged within an annular recess 30 of the adjustable annulus. A retaining ring 32 residing within a recess 34 of the body prevents adjustable annulus 26 from slipping off the body when set screw 28 temporarily does not secure the body and the annulus together. Between the adjustable annulus and housing 14 are a plurality of generally symmetrically placed springs 36 which normally bias the spring housing and the body together at their contacting recess 24 and flange 22.

Movement between the body and the spring housing is effected by means of an eccentric cam 40 which is, and operates, the same as that disclosed and described in U.S. Pat. No. 4,330,965 issued May 25, 1982. Cam 40 is rotatable within a cylindrical opening of housing 14 by a handle 50 which extends beyond the outer surface of housing 14. Cam 40 is adapted to rotate approximately 180° against the bias of springs 36 to compress them and to move body 12 and its plate 16 forward of housing 14 and its plate 18. Rotation of eccentric cam 40 is limited by means of a pin 56 (see FIG. 1) which is secured within spring housing 14 and which is contacted by stops (one of which is shown by indicium 62) on a plate 58 having a stepped periphery. The plate has a larger periphery 58*a*, whose radius is the same as that of a hole 60 within housing 14, and a smaller periphery 58*b* whose radius is less than that of hole 60. The points, at which peripheries 58*a* and 58*b* meet, define a pair of generally radial surfaces, such as surface 62. Thus, radial surfaces 62 act as stops which contact stationary pin 56 to limit rotation of cam 40.

As shown in FIG. 4, a plurality of contacts or ferrules 70, which terminate optical fibers 72 (for illustration, four are disclosed), are retained as a unitary structure within an assembly mount 73. Mount 73 fits into and is housed in a split cradle 74 (see also FIG. 1, wherein contacts 70, mount 73 and fibers 72 are removed). The split cradle is insertable in an adjustable carrier 100 (see also FIG. 3). Split cradle 74, which comprises a pair of mating halves 74*a* and 74*b*, has internal surfaces 76 which are configured as the exterior of ferrule assembly mount 73 and its strain relief 75. After placement of the mount within the first cradle half, the second half is placed over the first half to enclose the mount. The ends of ferrules 70 and fibers 72 are positioned to extend through openings 77 in both halves of cradle 74. A pair of alignment pins, one of which is identified by indicum 78*a*, on opposed cradle halves are receivable within holes 78*b* in their opposed cradle half to maintain alignment between the two halves. An annular groove 80 is formed from semicircular grooves on the cradle halves. Slots 82 in the cradles halves are disposed to key with pins 84 in body 12 to permit axial movement, but prevent rotation, of cradle 74 with respect to body 12.

The assembled cradle is received and held within adjustable carrier 100, see also FIGS. 1 and 3, by a clip 102. The clip comprises a pair of pivotable halves 102*a* and 102*b* which are mounted on the adjustable carrier by screws 103, on which they can pivot. The clip halves include U-shaped jaws 104 whose inner surfaces 104*a* are adapted to engage annular groove 80 of cradle 74. A pair of manipulating legs 105 extend from jaws 104 and are biased apart by a spring 106 which, therefore, maintains the jaws normally closed.

A key 108 (FIGS. 1 and 3) is pinned to a pivot 110 (FIG.1) on the periphery of carrier 100 and is biasable by a spring 112 into contact with a slot or keyway 114 formed in a periphery of adjustable annulus 26 in order to lock the adjustable annulus and carrier together and, as a consequence, the adjustable carrier to body 12. Adjustable carrier 100 further is coupled at threads 116 (FIG. 1) with body 12 so that, when key 108 is pivoted out of engagement with keyway 114, carrier 100 may be screwed into or out of body 12 and, therefore, the carrier both rotates and axially moves with respect to body 12. The rotational improvement, however, is not translated to cradle 74 because of the engagement of jaws 104 with groove 80 and of body pins 84 in cradle slots 82. Therefore, the axial movement of carrier 100 will be transmitted to cradle 74, which will move axially in the body and towards or away from plate 16. Inasmuch as ferrules or contacts 70 terminate in optical fiber bushings 120 which are received in holes 20, the threaded connection at 116 permits bushing 120 to be positioned adjacent the surface of brass squaring plate 16.

An adjustment mechanism is needed for the proper positioning of bushing 120 with respect to plate 16, and between plates 16 and 18 because the surfaces of the plates are of different hardness and subject to differential wear through the grinding and polishing operations. Specifically, all bushings 120 are generally of the same axial length and it is important that, before the initial grinding and polishing operations, the surfaces of all bushings 120 be flush with the surface of plate 16. The adjustment to make the surfaces flush with one another is effected through the intermediary of the attachment between adjustable annulus 26 and plate 12. First, set screw 28 is loosened so that adjustable carrier 100 and adjustable annulus 26 may be made to rotate together through the latching between key 108 and keyway 114. Rotation of these latched together parts through the intermediary of screw threads 116 permits the surfaces of bushings 120 to be moved toward or away from the end surface of plate 16. At the point that the end surfaces of bushings 120 and plate 16 are flush or where the bushing surfaces barely extend beyond the plate surface, set screw 28 is tightened. In this position, the tool is ready for the initial grinding operation.

Subsequent to this adjustment, tool 10 is used as follows. Ferrules 70, as connected to fibers 72 and their strain relief 75, have already been retained in assembly mount 73. The assembly mount is then placed in cradle half 74*a* or 74*b*. The cradle is closed by adding the second half to enclose assembly mount 73 and its contacts and stain relief housing. Jaws 104 are opened and the cradle is then inserted into adjustable carrier 100. The cradle is turned until body pins 84 engage cradle slots 82. Closing of the jaws places jaw surfaces 104*a* within cradle groove 80 under the action of spring 106 to retain the cradle and its fiber optic contact assembly mount 73 within body 12.

The tool is then readied for the initial grinding operation, after the factory adjustment using set screw 28, as described above. Preferably, a 3000 grit diamond wheel is utilized. For this grinding operation, stainless steel ring plate 18 must be flush with brass plate 16, as properly positioned by key device 40 when flange 22 abuts against recess 24. The tool face is then placed onto the grinding surface of the diamond wheel. During grinding, key 108 is unlatched from engagement with keyway 114 and adjustable carrier 100 is slowly turned clockwise one revolution until key 108 again relatches with the keyway. This operation causes bushings 120 and their contained ends of fibers 72 to be slightly ground, the purpose primarily being to grind the protruding fibers flush with guide bushings 120. The tool may be flushed with clean water to remove any debris left from the grinding operation.

Steel limiting ring 18 is then retracted by rotation of eccentric cam 40. This movement retracts spring housing 14. Brass plate 16, the bushing surface, and the fiber ends are then placed against a phenolic polishing wheel wetted preferably with a three micron cerium oxide emulsion. After proper polishing, the polished ferrules as contained in assembly mount 73, are removed by reversing carrier 100 by one revolution by unlatching and relatching key 108 with keyway 114. Cradle assembly 74 is then removed from adjustable carrier 100 by releasing jaws 104 from the cradle groove.

While four fibers 72, contacts or ferrules 70, bushings 120, and holes 20 have been depicted and illustrated as exemplary of the invention, any number may be employed, depending upon the requirements of the ultimate interconnection needed.

Consequently, although the invention has been described with reference to a particular embodiment thereof, it should be realized that various changes and modifications may be made therein without departing from the spirit and scope of the invention.

What is claimed is:

1. A tool for simultaneously grinding and polishing a plurality of optical fiber termini comprising:

an assembly mounting a plurality of fiber optic ferrules and their optical fibers in a specific and fixed order of their fiber optic termini;

a body having means including a carrier in threaded engagement with said body and supporting and positioning said assembly of ferrules and their fiber termini at a surface on said body, said body means having a first connection with said body for ensuring only linear movement of said assembly towards and away from said body surface and a second connection with said assembly for positioning said ferrules and said fiber termini with respect to said body surface, said assembly supporting means further including a split cradle insertable in said carrier and comprising a pair of halves having a cavity for receiving and holding said ferrules, and said second connection including an annular groove extending about said cradle and retaining means on said carrier engageable with said groove;

a housing surrounding said body and having a surface generally surrounding said body surface; and means interconnecting said housing and said body for effecting relative movements of retraction and extension therebetween and including a mechanism defining limits to the relative movements, respectively to place said body and housing surfaces in a coplanar position prior to grinding of the ferrules and their fiber termini and to move said body surface into a position forward of said housing surface prior to said polishing of the ferrules and their fiber termini.

2. A tool according to claim 1 wherein said housing surface is formed from a material which is harder than that of said body surface to limit removal of said body surface material and said ferrules and their fiber termini.

3. A tool according to claim 2 further including ferrule positioning means coupled between said body and said ferrules for positioning said ferrules and their fiber termini with respect to said body surface.

4. A tool according to claim 1 further including means between said carrier and said body for effecting fine adjustment of the position of said fiber termini at said body surface.

5. A tool according to claim 1 wherein said retaining means comprises spring-biased jaws normally engaged in said annular groove.

* * * * *